US009135867B2

(12) United States Patent
Yao

(10) Patent No.: US 9,135,867 B2
(45) Date of Patent: Sep. 15, 2015

(54) DISPLAY ELEMENT PIXEL CIRCUIT WITH VOLTAGE EQUALIZATION

(71) Applicant: Pixtronix, Inc., San Diego, CA (US)

(72) Inventor: Jianguo Yao, Londonderry, NH (US)

(73) Assignee: Pixtronix, Inc., San Diego, CA (US)

( * ) Notice: Subject to any disclaimer, the term of this patent is extended or adjusted under 35 U.S.C. 154(b) by 190 days.

(21) Appl. No.: 13/854,687

(22) Filed: Apr. 1, 2013

(65) Prior Publication Data

US 2014/0292738 A1 Oct. 2, 2014

(51) Int. Cl.
*G09G 3/34* (2006.01)

(52) U.S. Cl.
CPC ..... *G09G 3/3433* (2013.01); *G09G 2300/0814* (2013.01); *G09G 2300/0852* (2013.01); *G09G 2300/0861* (2013.01); *G09G 2310/0202* (2013.01); *G09G 2310/0251* (2013.01); *G09G 2310/061* (2013.01)

(58) Field of Classification Search
CPC ..... G09G 3/3466
See application file for complete search history.

(56) References Cited

U.S. PATENT DOCUMENTS

| | | | | |
|---|---|---|---|---|
| 7,196,837 | B2 | 3/2007 | Sampsell et al. | |
| 7,292,235 | B2 | 11/2007 | Nose | |
| 7,345,805 | B2 | 3/2008 | Chui | |
| 8,526,096 | B2 | 9/2013 | Steyn et al. | |
| 8,692,582 | B1 * | 4/2014 | Atesoglu et al. | 327/65 |
| 2002/0051096 | A1 | 5/2002 | Yamazaki et al. | |
| 2006/0066598 | A1 * | 3/2006 | Floyd | 345/204 |
| 2007/0086078 | A1 | 4/2007 | Hagood et al. | |
| 2008/0174532 | A1 * | 7/2008 | Lewis | 345/85 |
| 2011/0164067 | A1 | 7/2011 | Lewis et al. | |
| 2012/0306562 | A1 | 12/2012 | Miyamoto et al. | |

FOREIGN PATENT DOCUMENTS

| | | | |
|---|---|---|---|
| CN | 1540621 | A | 10/2004 |
| EP | 2037440 | A2 | 3/2009 |
| JP | 2002139683 | A | 5/2002 |
| TW | 530175 | B | 5/2003 |

(Continued)

OTHER PUBLICATIONS

International Search Report and Written Opinion—PCT/US2012/040238—ISA/EPO—Dec. 13, 2012.

(Continued)

*Primary Examiner* — Quan-Zhen Wang
*Assistant Examiner* — Chad Dicke
(74) *Attorney, Agent, or Firm* — Edward A. Gordon; Foley & Lardner LLP

(57) ABSTRACT

This disclosure provides systems, methods and apparatus for improving the reliability of dual actuator light modulators by equalizing voltages provided to the two actuators of the light modulator. A pixel circuit for driving the dual actuator light modulator can include a data loading circuit coupled to an actuation circuit. The data loading circuit is utilized to store data received from a controller for a pixel associated with the light modulator. The actuation circuit is utilized to control a first actuator and a second actuator of the dual actuator light modulator based on the data stored by the data loading circuit. The actuation circuit includes a first stabilization capacitor and a second stabilization capacitor for stabilizing voltages provided to the first and second actuators. The actuation circuit also includes an equalization switch for equalizing voltages provided to the first and second actuators.

20 Claims, 8 Drawing Sheets

(56) References Cited

FOREIGN PATENT DOCUMENTS

| | | | |
|---|---|---|---|
| TW | 200901629 | A | 1/2009 |
| WO | 2009102471 | A1 | 8/2009 |

OTHER PUBLICATIONS

International Search Report and Written Opinion—PCT/US2014/032206—ISA/EPO—Jun. 26, 2014.

* cited by examiner

DISPLAY ELEMENT PIXEL CIRCUIT WITH VOLTAGE EQUALIZATION

TECHNICAL FIELD

This disclosure relates to the field of imaging displays, and in particular to pixel circuits for display elements.

DESCRIPTION OF THE RELATED TECHNOLOGY

Various display apparatus include an array of display pixels that have corresponding light modulators that transmit light to form images. The light modulators include actuators for driving the light modulators between a first state and a second state. Some display apparatus utilize dual-actuation light modulators that can be driven into the first state by a first actuator and the second state by a second actuator. The light modulators are controlled by a pixel circuit or control matrix.

In some implementations, the pixel circuits can include complementary sub-circuits each driving one actuator of a dual actuation light modulator. These sub-circuits may suffer from capacitance bootstrapping, which may undesirably increase the voltage driving one of the actuators. This increased voltage can decrease the reliability of the pixel circuits.

SUMMARY

The systems, methods and devices of the disclosure each have several innovative aspects, no single one of which is solely responsible for the desirable attributes disclosed herein.

One innovative aspect of the subject matter described in this disclosure can be implemented in an apparatus including an array of display elements and a control matrix configured to control the optical output of the array of display elements. The control matrix includes for each of the display elements a first circuit having a first charge transistor configured to govern the application to a first node of a respective display element of a first actuation voltage supplied by a first actuation voltage interconnect, and a first discharge transistor configured to selectively discharge the voltage applied to the first node in response to a data signal supplied to the gate of the first discharge transistor. The control matrix further includes for each of the display elements a second circuit having a second charge transistor configured to govern the application to a second node of the respective display element of a second actuation voltage, and a second discharge transistor configured to selectively discharge the voltage applied to the second node in response to the voltage on the first node. The control matrix further includes a voltage equalization switch selectively coupling the first node to the second node in response to the first actuation voltage supplied by the first actuation interconnect.

In some implementations, the first circuit further includes a third discharge transistor positioned between a first terminal of the first charge transistor and a first terminal of the first discharge transistor configured to selectively retain a voltage on the first node responsive to a voltage stored on the second node. In some implementations, the first actuation voltage interconnect couples to the gate and the drain of the first charge transistor and the gate of the voltage equalization switch. In some implementations, the first actuation voltage interconnect is further coupled to a second terminal of the first discharge transistor. In some implementations, the apparatus further includes a first capacitor coupled to the first node and a second capacitor coupled to the second node.

In some implementations, the apparatus further includes a data storage circuit coupled to the gate of the first discharge transistor, the data storage circuit configured to store the data signal corresponding to a data input and supply the data signal to the gate of the first discharge transistor. In some implementations, the data storage circuit includes a data storage capacitor coupled to the gate of the first discharge transistor, the data storage capacitor configured to store charge corresponding to the data signal. In some implementations, all transistors of the first circuit and the second circuit are nMOS transistors.

In some implementations, the apparatus further includes a display including the array of display elements and the control matrix, a processor that is configured to communicate with the display, the processor being configured to process image data, and a memory device that is configured to communicate with the processor. In some implementations, the apparatus further includes a driver circuit configured to send at least one signal to the display, and a controller configured to send at least a portion of the image data to the driver circuit. In some implementations, the apparatus further includes, an image source module configured to send the image data to the processor, where the image source module includes at least one of a receiver, transceiver, and transmitter. In some implementations, the display device further includes an input device configured to receive input data and to communicate the input data to the processor.

Another innovative aspect of the subject matter described in this disclosure can be implemented in a method for actuating a light modulator having a first actuator and a second actuator using a pixel circuit coupled to the light modulator. The method includes charging a first output node of the pixel circuit, the first output node coupled to the first actuator, in response to a voltage supplied by a first actuation interconnect, charging a second output node of the pixel circuit, the second output node coupled to the second actuator, in response to a voltage supplied by a second actuation interconnect, equalizing voltages at the first output node and the second output node in response to the voltage supplied by the first actuation interconnect, and selectively discharging the first output node and the second output node in response to a data voltage provided by a data interconnect.

In some implementations, the method further includes activating a latching circuitry for maintaining voltages at the first output node and the second output node after selectively discharging the first output node and the second output node. In some implementations, equalizing voltages at the first output node and the second output node includes allowing current to flow between the first output node and the second output node via a switch driven by the voltage provided by the first actuation interconnect. In some other implementations, equalizing voltages at the first output node and the second output node further includes discontinuing current flow between the first output node and the second output node via the switch prior to selectively discharging the first output node and the second output node. In some implementations, a duration for charging the first output node is less than a duration for charging the second output node.

Another innovative aspect of the subject matter described in this disclosure can be implemented in an apparatus including an array of display elements and control matrix means for controlling the optical output of the array of display elements. The control matrix means includes, for each of the display elements, a first circuit having first charging means for governing the application to a first node of a respective display element of a first actuation voltage supplied by a first actuation voltage interconnect, and first discharging means for selectively discharging the voltage applied to the first node in response to a data signal supplied to the gate of the first discharge transistor. The control matrix means further includes, for each of the display elements, a second circuit having second charging means for governing the application to a second node of the respective display element of a second actuation voltage, second discharging means for selectively discharging the voltage applied to the second node in response to the voltage on the first node, and means for equalizing voltages at the first node and the second node in response to the first actuation voltage supplied by the first actuation interconnect.

In some implementations, the first circuit further includes third discharging means positioned between a first terminal of the first charging means and a first terminal of the first discharging means for selectively retaining a voltage on the first node responsive to a voltage stored on the second node. In some implementations, the apparatus further includes first charge storage means coupled to the first node for storing charge at the first node, and second charge storage means coupled to the second node for storing charge at the second node.

Details of one or more implementations of the subject matter described in this specification are set forth in the accompanying drawings and the description below. Although the examples provided in this summary are primarily described in terms of electromechanical systems (EMS) based displays, the concepts provided herein may apply to other types of displays, such as liquid crystal displays (LCD), organic light-emitting diode (OLED) displays, electrophoretic displays, and field emission displays, as well as to other non-display EMS devices, such as EMS microphones, sensors, and optical switches. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1A:
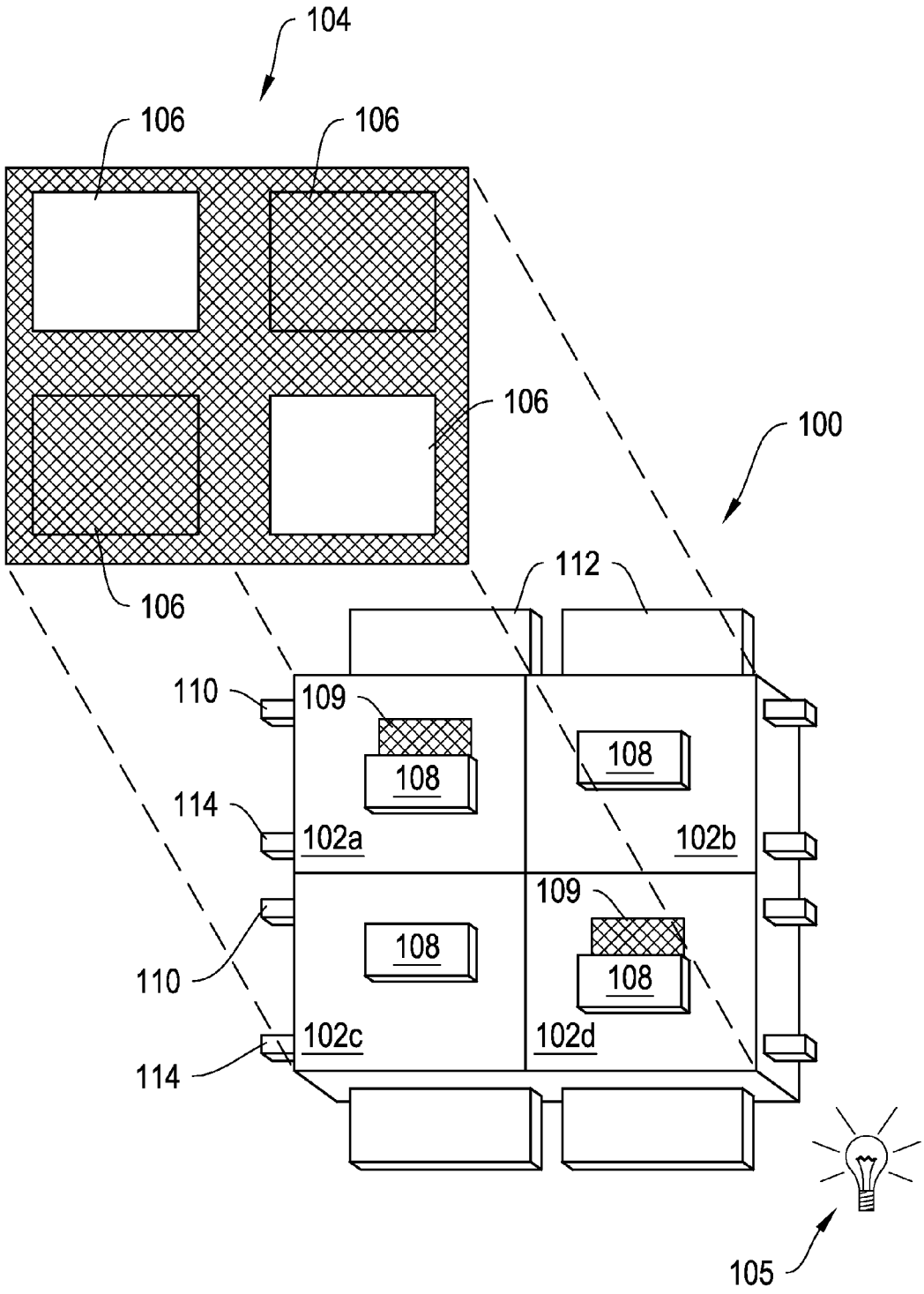
FIG. 1A shows a schematic diagram of an example direct-view microelectromechanical systems (MEMS) based display apparatus.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that can be configured to display an image, whether in motion (such as video) or stationary (such as still images), and whether textual, graphical or pictorial. More particularly, it is contemplated that the described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, clocks, calculators, television monitors, flat panel displays, electronic reading devices (for example, e-readers), computer monitors, auto displays (including odometer and speedometer displays, etc.), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS) applications including microelectromechanical systems (MEMS) applications, as well as non-EMS applications), aesthetic structures (such as display of images on a piece of jewelry or clothing) and a variety of EMS devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

A pixel circuit for driving a dual actuator light modulator can include a data loading circuit coupled to an actuation circuit. The data loading circuit is utilized to store data received from a controller for a pixel associated with the light modulator. The actuation circuit is utilized to control a first actuator and a second actuator of the dual actuator light modulator based on the data stored by the data loading circuit. The actuation circuit includes a first output node to control the voltage supplied to the first actuator and a second output node to control the voltage supplied to the second actuator.

In some implementations, the pixel circuit can incorporate a first stabilization capacitor and a second stabilization capacitor at the first output node and the second output node, respectively to provide voltage stabilization at the first output node and the second output node, respectively. In some implementations, the pixel circuit incorporates an equalization switch coupled between the first output node and the second output node to equalize voltages supplied to the first and the second actuator.

Particular implementations of the subject matter described in this disclosure can be implemented to realize one or more of the following potential advantages. Incorporating stabilization capacitors at output nodes of a pixel circuit controlling a dual actuator light modulator can increase the reliability of the light modulator. The pixel circuit can also incorporate a voltage equalization switch coupled between the output nodes of the pixel circuit. The equalization switch can be switched ON to equalize voltages between the output nodes of the pixel circuit. By equalizing the voltages between the output nodes, undesirable voltage swings at the output nodes due to capacitor bootstrapping are mitigated. This greatly relaxes signal timing requirements and reduces the operational complexity of the pixel circuit.

FIG. 1A shows a schematic diagram of an example direct-view MEMS-based display apparatus 100. The display apparatus 100 includes a plurality of light modulators 102*a*-102*d* (generally "light modulators 102") arranged in rows and columns. In the display apparatus 100, the light modulators 102*a* and 102*d* are in the open state, allowing light to pass. The light modulators 102*b* and 102*c* are in the closed state, obstructing the passage of light. By selectively setting the states of the light modulators 102*a*-102*d*, the display apparatus 100 can be utilized to form an image 104 for a backlit display, if illuminated by a lamp or lamps 105. In another implementation, the apparatus 100 may form an image by reflection of ambient light originating from the front of the apparatus. In another implementation, the apparatus 100 may form an image by reflection of light from a lamp or lamps positioned in the front of the display, i.e., by use of a front light.

In some implementations, each light modulator 102 corresponds to a pixel 106 in the image 104. In some other implementations, the display apparatus 100 may utilize a plurality of light modulators to form a pixel 106 in the image 104. For example, the display apparatus 100 may include three color-specific light modulators 102. By selectively opening one or more of the color-specific light modulators 102 corresponding to a particular pixel 106, the display apparatus 100 can generate a color pixel 106 in the image 104. In another example, the display apparatus 100 includes two or more light modulators 102 per pixel 106 to provide luminance level in an image 104. With respect to an image, a "pixel" corresponds to the smallest picture element defined by the resolution of image. With respect to structural components of the display apparatus 100, the term "pixel" refers to the combined mechanical and electrical components utilized to modulate the light that forms a single pixel of the image.

The display apparatus 100 is a direct-view display in that it may not include imaging optics typically found in projection applications. In a projection display, the image formed on the surface of the display apparatus is projected onto a screen or onto a wall. The display apparatus is substantially smaller than the projected image. In a direct view display, the user sees the image by looking directly at the display apparatus, which contains the light modulators and optionally a backlight or front light for enhancing brightness and/or contrast seen on the display.

Direct-view displays may operate in either a transmissive or reflective mode. In a transmissive display, the light modulators filter or selectively block light which originates from a lamp or lamps positioned behind the display. The light from the lamps is optionally injected into a lightguide or "backlight" so that each pixel can be uniformly illuminated. Transmissive direct-view displays are often built onto transparent or glass substrates to facilitate a sandwich assembly arrangement where one substrate, containing the light modulators, is positioned directly on top of the backlight.

Each light modulator 102 can include a shutter 108 and an aperture 109. To illuminate a pixel 106 in the image 104, the shutter 108 is positioned such that it allows light to pass through the aperture 109 towards a viewer. To keep a pixel 106 unlit, the shutter 108 is positioned such that it obstructs the passage of light through the aperture 109. The aperture 109 is defined by an opening patterned through a reflective or light-absorbing material in each light modulator 102.

The display apparatus also includes a control matrix connected to the substrate and to the light modulators for controlling the movement of the shutters. The control matrix includes a series of electrical interconnects (e.g., interconnects 110, 112 and 114), including at least one write-enable interconnect 110 (also referred to as a "scan-line interconnect") per row of pixels, one data interconnect 112 for each column of pixels, and one common interconnect 114 providing a common voltage to all pixels, or at least to pixels from both multiple columns and multiples rows in the display apparatus 100. In response to the application of an appropriate voltage (the "write-enabling voltage, $V_{WE}$"), the write-enable interconnect 110 for a given row of pixels prepares the pixels in the row to accept new shutter movement instructions. The data interconnects 112 communicate the new movement instructions in the form of data voltage pulses. The data voltage pulses applied to the data interconnects 112, in some implementations, directly contribute to an electrostatic movement of the shutters. In some other implementations, the data voltage pulses control switches, e.g., transistors or other non-linear circuit elements that control the application of separate actuation voltages, which are typically higher in magnitude than the data voltages, to the light modulators 102. The application of these actuation voltages then results in the electrostatic driven movement of the shutters 108.

Figure 1B:
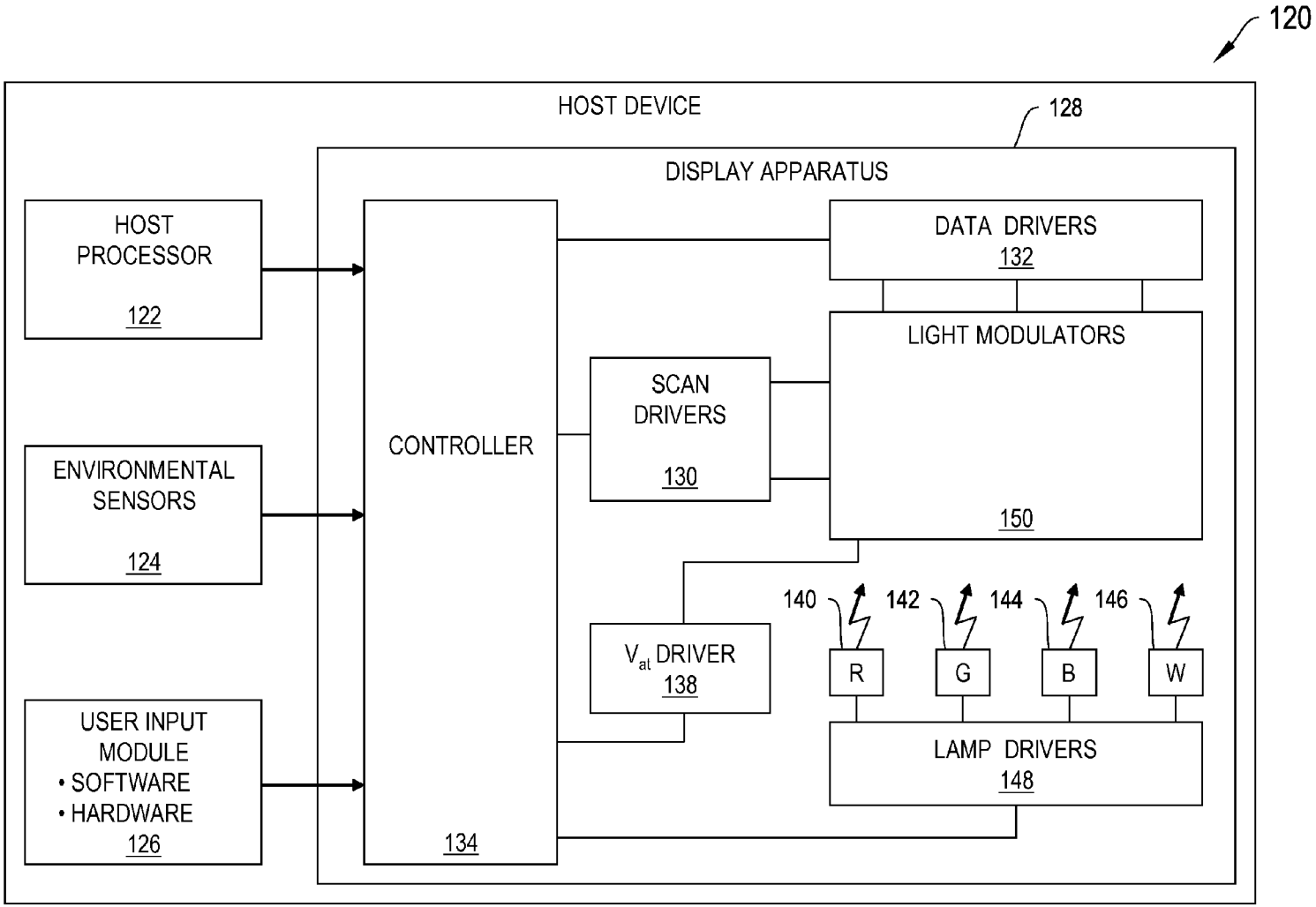
FIG. 1B shows a block diagram of an example host device.

FIG. 1B shows a block diagram of an example host device 120 (i.e., cell phone, smart phone, PDA, MP3 player, tablet, e-reader, netbook, notebook, etc.). The host device 120 includes a display apparatus 128, a host processor 122, environmental sensors 124, a user input module 126, and a power source.

The display apparatus 128 includes a plurality of scan drivers 130 (also referred to as "write enabling voltage sources"), a plurality of data drivers 132 (also referred to as "data voltage sources"), a controller 134, common drivers 138, lamps 140-146, lamp drivers 148 and an array 150 of display elements, such as the light modulators 102 shown in FIG. 1A. The scan drivers 130 apply write enabling voltages to scan-line interconnects 110. The data drivers 132 apply data voltages to the data interconnects 112.

In some implementations of the display apparatus, the data drivers 132 are configured to provide analog data voltages to the array 150 of display elements, especially where the luminance level of the image 104 is to be derived in analog fashion. In analog operation, the light modulators 102 are designed such that when a range of intermediate voltages is applied through the data interconnects 112, there results a range of intermediate open states in the shutters 108 and therefore a range of intermediate illumination states or luminance levels in the image 104. In other cases, the data drivers 132 are configured to apply only a reduced set of 2, 3 or 4 digital voltage levels to the data interconnects 112. These voltage levels are designed to set, in digital fashion, an open state, a closed state, or other discrete state to each of the shutters 108.

The scan drivers 130 and the data drivers 132 are connected to a digital controller circuit 134 (also referred to as the "controller 134"). The controller sends data to the data drivers 132 in a mostly serial fashion, organized in predetermined sequences grouped by rows and by image frames. The data drivers 132 can include series to parallel data converters, level shifting, and for some applications digital to analog voltage converters.

The display apparatus optionally includes a set of common drivers 138, also referred to as common voltage sources. In some implementations, the common drivers 138 provide a DC common potential to all display elements within the array 150 of display elements, for instance by supplying voltage to a series of common interconnects 114. In some other implementations, the common drivers 138, following commands from the controller 134, issue voltage pulses or signals to the array 150 of display elements, for instance global actuation pulses which are capable of driving and/or initiating simultaneous actuation of all display elements in multiple rows and columns of the array 150.

All of the drivers (e.g., scan drivers 130, data drivers 132 and common drivers 138) for different display functions are time-synchronized by the controller 134. Timing commands from the controller coordinate the illumination of red, green and blue and white lamps (140, 142, 144 and 146 respectively) via lamp drivers 148, the write-enabling and sequencing of specific rows within the array 150 of display elements, the output of voltages from the data drivers 132, and the output of voltages that provide for display element actuation. In some implementations, the lamps are light emitting diodes (LEDs).

The controller 134 determines the sequencing or addressing scheme by which each of the shutters 108 can be re-set to the illumination levels appropriate to a new image 104. New images 104 can be set at periodic intervals. For instance, for video displays, the color images 104 or frames of video are refreshed at frequencies ranging from 10 to 300 Hertz (Hz). In some implementations the setting of an image frame to the array 150 is synchronized with the illumination of the lamps 140, 142, 144 and 146 such that alternate image frames are illuminated with an alternating series of colors, such as red, green, and blue. The image frames for each respective color is referred to as a color subframe. In this method, referred to as the field sequential color method, if the color subframes are alternated at frequencies in excess of 20 Hz, the human brain will average the alternating frame images into the perception of an image having a broad and continuous range of colors. In alternate implementations, four or more lamps with primary colors can be employed in display apparatus 100, employing primaries other than red, green, and blue.

In some implementations, where the display apparatus 100 is designed for the digital switching of shutters 108 between open and closed states, the controller 134 forms an image by the method of time division gray scale, as previously described. In some other implementations, the display apparatus 100 can provide gray scale through the use of multiple shutters 108 per pixel.

In some implementations, the data for an image state 104 is loaded by the controller 134 to the display element array 150 by a sequential addressing of individual rows, also referred to as scan lines. For each row or scan line in the sequence, the scan driver 130 applies a write-enable voltage to the write enable interconnect 110 for that row of the array 150, and subsequently the data driver 132 supplies data voltages, corresponding to desired shutter states, for each column in the selected row. This process repeats until data has been loaded for all rows in the array 150. In some implementations, the sequence of selected rows for data loading is linear, proceeding from top to bottom in the array 150. In some other implementations, the sequence of selected rows is pseudo-randomized, in order to minimize visual artifacts. And in some other implementations the sequencing is organized by blocks, where, for a block, the data for only a certain fraction of the image state 104 is loaded to the array 150, for instance by addressing only every $5^{th}$ row of the array 150 in sequence.

In alternative implementations, the array 150 of display elements and the control matrix that controls the display elements may be arranged in configurations other than rectangular rows and columns. For example, the display elements can be arranged in hexagonal arrays or curvilinear rows and columns. In general, as used herein, the term scan-line shall refer to any plurality of display elements that share a write-enabling interconnect.

The host processor 122 generally controls the operations of the host. For example, the host processor 122 may be a general or special purpose processor for controlling a portable electronic device. With respect to the display apparatus 128, included within the host device 120, the host processor 122 outputs image data as well as additional data about the host. Such information may include data from environmental sensors, such as ambient light or temperature; information about the host, including, for example, an operating mode of the host or the amount of power remaining in the host's power source; information about the content of the image data; information about the type of image data; and/or instructions for display apparatus for use in selecting an imaging mode.

The user input module 126 conveys the personal preferences of the user to the controller 134, either directly, or via the host processor 122. In some implementations, the user input module 126 is controlled by software in which the user programs personal preferences such as "deeper color," "better contrast," "lower power," "increased brightness," "sports," "live action," or "animation." In some other implementations, these preferences are input to the host using hardware, such as a switch or dial. The plurality of data inputs to the controller 134 direct the controller to provide data to the various drivers 130, 132, 138 and 148 which correspond to optimal imaging characteristics.

An environmental sensor module 124 also can be included as part of the host device 120. The environmental sensor module 124 receives data about the ambient environment, such as temperature and/or ambient lighting conditions. The sensor module 124 can be programmed to distinguish whether the device is operating in an indoor or office environment versus an outdoor environment in bright daylight versus an outdoor environment at nighttime. The sensor module 124 communicates this information to the display controller 134, so that the controller 134 can optimize the viewing conditions in response to the ambient environment.

Figure 2B:
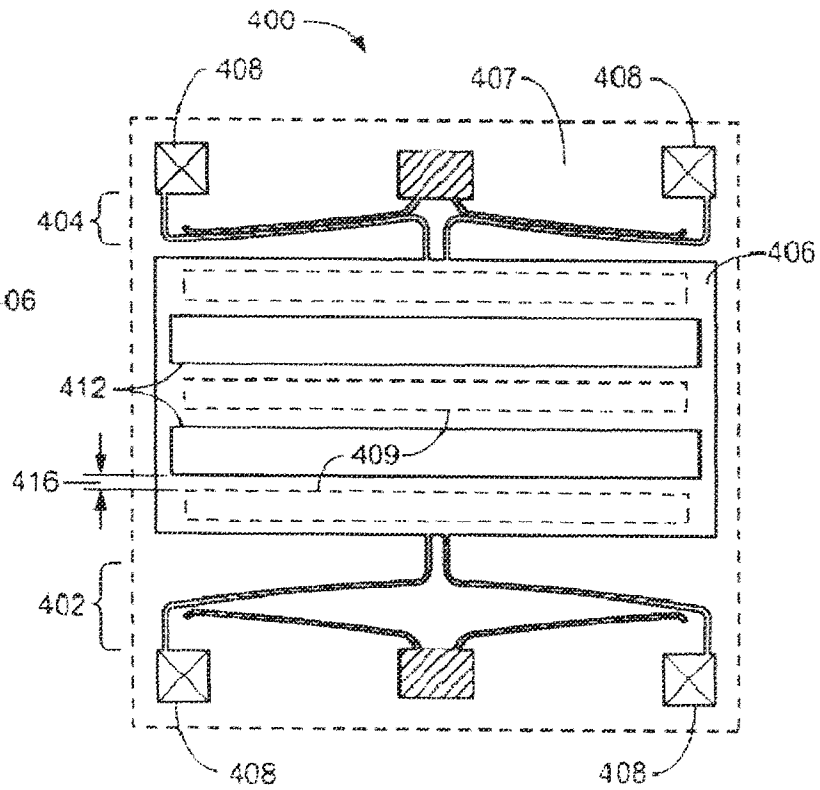
FIGS. 2A and 2B show views of an example dual actuator shutter assembly.
Figure 2A:
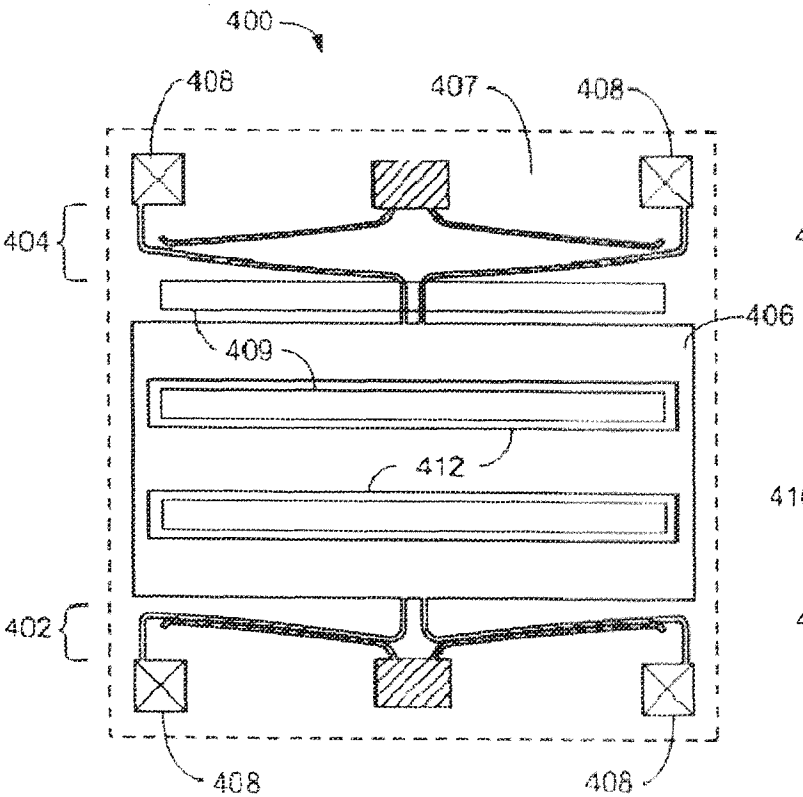

FIGS. 2A and 2B show views of an example shutter based light modulator 400. The light modulator (also referred to as "dual actuator shutter assembly") 400 can include dual actuators for actuating a shutter. The dual actuator shutter assembly 400 can be suitable for incorporation into the direct view MEMS-based display apparatus 100 of FIG. 1A as the light modulator 102. The dual actuator shutter assembly 400, as depicted in FIG. 2A, is in an open state. FIG. 2B shows the dual actuator shutter assembly 400 in a closed state. The shutter assembly 400 includes actuators 402 and 404 on either side of a shutter 406. Each actuator 402 and 404 is independently controlled. A first actuator, a shutter-open actuator 402, serves to open the shutter 406. A second opposing actuator, the shutter-close actuator 404, serves to close the shutter 406. Both of the actuators 402 and 404 are compliant beam electrode actuators. The actuators 402 and 404 open and close the shutter 406 by driving the shutter 406 substantially in a plane parallel to an aperture layer 407 over which the shutter is suspended. The shutter 406 is suspended a short distance over the aperture layer 407 by anchors 408 attached to the actuators 402 and 404. The inclusion of supports attached to both ends of the shutter 406 along its axis of movement reduces out of plane motion of the shutter 406 and confines the motion substantially to a plane parallel to the substrate. As will be described below, a variety of different control matrices may be used with the shutter assembly 400.

The shutter 406 includes two shutter apertures 412 through which light can pass. The aperture layer 407 includes a set of three apertures 409. In FIG. 2A, the shutter assembly 400 is in the open state and, as such, the shutter-open actuator 402 has been actuated, the shutter-close actuator 404 is in its relaxed position, and the centerlines of the shutter apertures 412 coincide with the centerlines of two of the aperture layer apertures 409. In FIG. 2B, the shutter assembly 400 has been moved to the closed state and, as such, the shutter-open actuator 402 is in its relaxed position, the shutter-close actuator 404 has been actuated, and the light blocking portions of the shutter 406 are now in position to block transmission of light through the apertures 409 (depicted as dotted lines).

Each aperture has at least one edge around its periphery. For example, the rectangular apertures 409 have four edges. In alternative implementations in which circular, elliptical, oval, or other curved apertures are formed in the aperture layer 407, each aperture may have only a single edge. In some other implementations, the apertures need not be separated or disjoint in the mathematical sense, but instead can be connected. That is to say, while portions or shaped sections of the aperture may maintain a correspondence to each shutter, several of these sections may be connected such that a single continuous perimeter of the aperture is shared by multiple shutters.

In order to allow light with a variety of exit angles to pass through apertures 412 and 409 in the open state, it is advantageous to provide a width or size for shutter apertures 412 which is larger than a corresponding width or size of apertures 409 in the aperture layer 407. In order to effectively block light from escaping in the closed state, it is preferable that the light blocking portions of the shutter 406 overlap the apertures 409. FIG. 2B shows a predefined overlap 416 between the edge of light blocking portions in the shutter 406 and one edge of the aperture 409 formed in the aperture layer 407.

The electrostatic actuators 402 and 404 are designed so that their voltage-displacement behavior provides a bi-stable characteristic to the shutter assembly 400. For each of the shutter-open and shutter-close actuators, there exists a range of voltages below the actuation voltage, which if applied while that actuator is in the closed state (with the shutter being either open or closed), will hold the actuator closed and the shutter in position, even after an actuation voltage is applied to the opposing actuator. The minimum voltage needed to maintain a shutter's position against such an opposing force is referred to as a maintenance voltage $V_m$.

Generally, electrical bi-stability in electrostatic actuators, such as actuators 402 and 404, arises from the fact that the electrostatic force across an actuator is a strong function of position as well as voltage. The beams of the actuators in the light modulators 400 and 450 act as capacitor plates. The force between capacitor plates is proportional to $1/d^2$ where d is the local separation distance between capacitor plates. When the actuator is in a closed state, the local separation between the actuator beams is very small. Thus, the application of a small voltage can result in a relatively strong force between the actuator beams of the actuator in the closed state. As a result, a relatively small voltage, such as $V_m$, can keep the actuator in the closed state, even if other elements exert an opposing force on the actuator.

In dual-actuator light modulators, such as 400 and 450, the equilibrium position of the light modulator will be determined by the combined effect of the voltage differences across each of the actuators. In other words, the electrical potentials of the three terminals, namely, the shutter open drive beam, the shutter close drive beam, and the load beams, as well as modulator position, are considered to determine the equilibrium forces on the modulator.

For an electrically bi-stable system, a set of logic rules can describe the stable states and can be used to develop reliable addressing or digital control schemes for a given light modulator. Referring to the shutter-based light modulator 400 as an example, these logic rules are as follows:

Let $V_s$ be the electrical potential on the shutter or load beam. Let $V_o$ be the electrical potential on the shutter-open drive beam. Let $V_c$ be the electrical potential on the shutter-close drive beam. Let the expression $|V_o-V_s|$ refer to the absolute value of the voltage difference between the shutter and the shutter-open drive beam. Let $V_m$ be the maintenance voltage. Let $V_{at}$ be the actuation threshold voltage, i.e., the voltage to actuate an actuator absent the application of $V_m$ to an opposing drive beam. Let $V_{max}$ be the maximum allowable potential for $V_o$ and $V_c$. Let $V_m<V_{at}<V_{max}$. Then, assuming $V_o$ and $V_c$ remain below $V_{max}$:

$$\text{If } |V_o-V_s|<V_m \text{ and } |V_c-V_s|<V_m \quad \text{(rule 1)}$$

Then the shutter will relax to the equilibrium position of its mechanical spring.

$$\text{If } |V_o-V_s|>V_m \text{ and } |V_c-V_s|>V_m \quad \text{(rule 2)}$$

Then the shutter will not move, i.e., it will hold in either the open or the closed state, whichever position was established by the last actuation event.

$$\text{If } |V_o-V_s|>V_{at} \text{ and } |V_c-V_s|<V_m \quad \text{(rule 3)}$$

Then the shutter will move into the open position.

$$\text{If } |V_o-V_s|<V_m \text{ and } |V_c-V_s|>V_{at} \quad \text{(rule 4)}$$

Then the shutter will move into the closed position.

Following rule 1, with voltage differences on each actuator near zero, the shutter will relax. In many shutter assemblies, the mechanically relaxed position is only partially open or closed, and so this voltage condition is usually avoided in an addressing scheme.

The condition of rule 2 makes it possible to include a global actuation function into an addressing scheme. By maintaining a shutter voltage which provides beam voltage differences that are at least the maintenance voltage, $V_m$, the absolute values of the shutter open and shutter closed potentials can be altered or switched in the midst of an addressing sequence over wide voltage ranges (even where voltage differences exceed $V_{at}$) with no danger of unintentional shutter motion.

The conditions of rules 3 and 4 are those that are generally targeted during the addressing sequence to ensure the bi-stable actuation of the shutter.

The maintenance voltage difference, $V_m$, can be designed or expressed as a certain fraction of the actuation threshold voltage, $V_{at}$. For systems designed for a useful degree of bi-stability, the maintenance voltage can exist in a range between about 20% and about 80% of $V_{at}$. This helps ensure that charge leakage or parasitic voltage fluctuations in the system do not result in a deviation of a set holding voltage out of its maintenance range—a deviation which could result in the unintentional actuation of a shutter. In some systems an exceptional degree of bi-stability or hysteresis can be provided, with $V_m$ existing over a range of about 2% and about 98% of $V_{at}$. In these systems, however, care must be taken to ensure that an electrode voltage condition of $V<V_m$ can be reliably obtained within the addressing and actuation time available.

In some implementations, the first and second actuators of each light modulator are coupled to a latch or a drive circuit to ensure that the first and second states of the light modulator are the only two stable states that the light modulator can assume.

Figure 3:
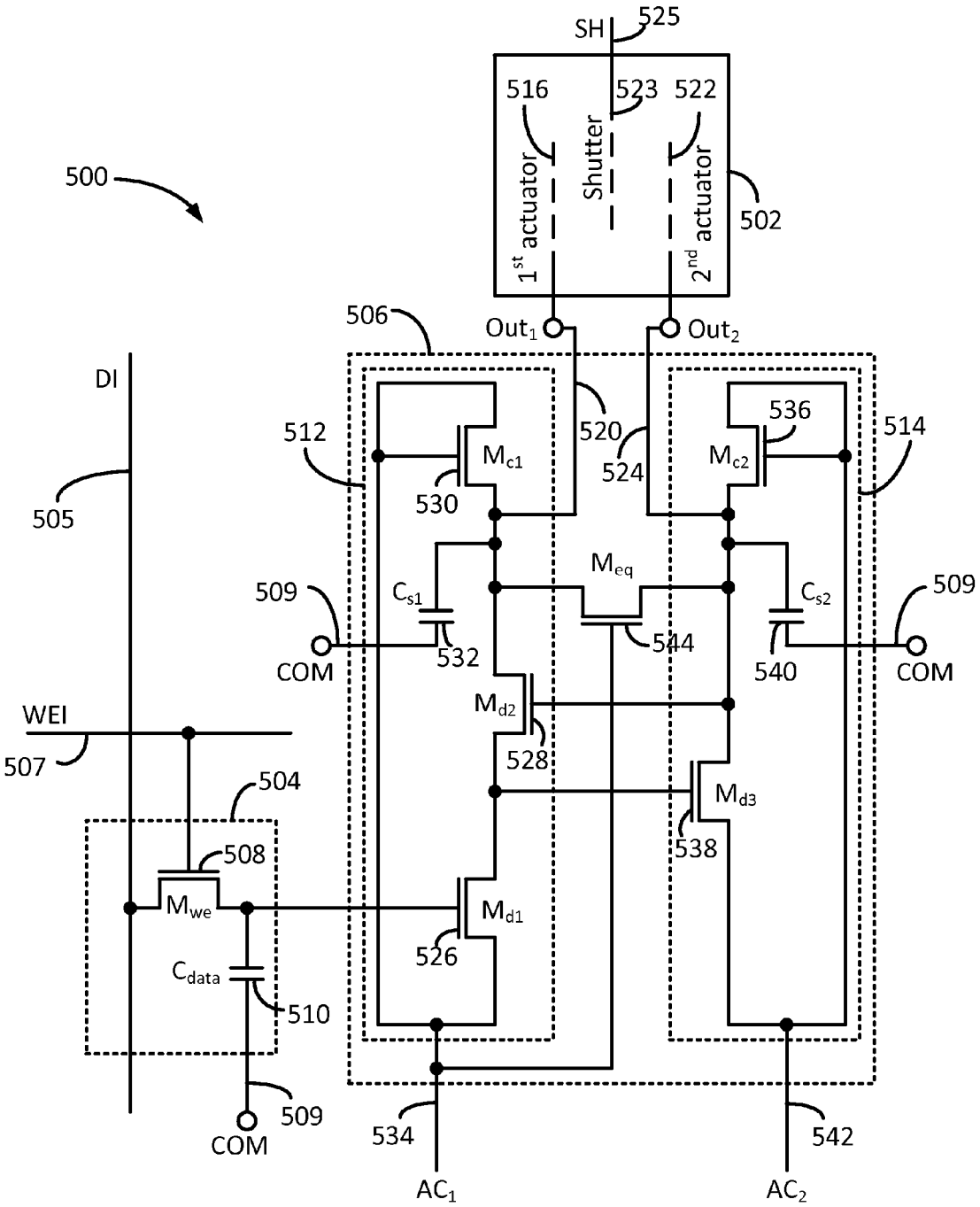
FIG. 3 shows an example pixel circuit that can be implemented for controlling a light modulator.

FIG. 3 shows an example pixel circuit 500 that can be implemented for controlling a light modulator 502. In particular, the pixel circuit 500 can be used to control dual actuator light modulators, such as the light modulator 400 shown in FIGS. 2A and 2B. The pixel circuit 500 can be part of a control matrix that controls an array of pixels that incorporate light modulators similar to the light modulator 502.

The pixel circuit 500 includes a data loading circuit 504 coupled to an actuation circuit 506. The data loading circuit 504 receives and stores data associated with the pixel, while the actuation circuit 506 actuates the light modulator 502 based on the data stored by the data loading circuit 504. In some implementations, such as the one shown in FIG. 3, various components of the pixel circuit 500 are implemented using MOSFETs. As can be readily understood by a person skilled in the art, the MOSFETs are three terminal transistors having a gate terminal, source terminal, and a drain terminal. The gate terminal can act as a control terminal such that a voltage applied to the gate terminal in relation to the source terminal can switch the MOSFET ON or OFF. In the ON state, the MOSFET allows electrical current flow from the source terminal to the drain terminal or vice versa. In the OFF state, the MOSFET substantially blocks any current flow from the source to the drain or vice versa. The implementation of the pixel circuit 500, however, is not limited to MOSFETS, and other transistors such as bipolar junction transistors also may be utilized. In some implementations, such as the one shown in FIG. 3, various components of the pixel circuit 500 can be implemented using only nMOS type transistors. However, the pixel circuit 500 can be readily implemented using only nMOS type transistors, or using both nMOS and pMOS type transistors.

As mentioned above, the data loading circuit 504 is used to load data associated with the pixel. Specifically, the data loading circuit 504 is coupled to a data interconnect (DI) 505 which is common to all the pixels in the same column. The data interconnect 505 is energized with a voltage corresponding to the data to be loaded into the pixel. In some implementations, the voltage corresponding to a data value of 1 can be higher than the voltage corresponding to a data value of 0. The data loading circuit 504 is also coupled to a write enabling interconnect (WEI) 507, which is common to all pixels in the same row as the pixel. When the write enabling interconnect 507 is energized with a write enabling voltage, the data loading circuit 504 loads data provided on the data interconnect 505.

To accomplish the data loading function, the data loading circuit 504 includes a write enable transistor ($M_{we}$) 508 and a data storage capacitor ($C_{data}$) 510. The write enabling transistor 508 can be a controllable transistor switch, the operation of which can be controlled by the write enabling voltage on the write enabling interconnect 507. The gate terminal of the write enable transistor 508 can be coupled to the write enabling interconnect 507. One of the drain or source terminals of the write enable transistor 508 can be coupled to data interconnect 505, while the other of the source or drain terminal can be coupled to a data storage capacitor 510. The data storage capacitor 510 can be used to store a voltage that is representative of the data provided by the data interconnect 505. One terminal of the data storage capacitor 510 is coupled to the write enable transistor 508, while the other terminal of the data storage capacitor 510 is coupled to a common interconnect (COM) 509. The common interconnect provides a common reference or ground voltage to all pixels in the display apparatus.

As mentioned above, the data loading circuit 504 is coupled to the actuation circuit 506. Specifically, the data storage capacitor 510 is coupled to a first actuation sub-circuit 512. The actuation circuit 506 also includes a second actuation sub-circuit 514 cross-coupled to the first actuation sub-circuit 512. The first actuation sub-circuit 512 governs a first output voltage supplied to a first actuator 516 of the light modulator 502. The first actuation sub-circuit 512 is coupled to the first actuator 516 via a first output node ($Out_1$) 520. The second actuation sub-circuit 514 governs a second output voltage supplied to a second actuator 522 of the light modulator 502. The second actuation sub-circuit 514 is coupled to the second actuator 522 via a second output node ($Out_2$) 524. The light modulator also includes a shutter terminal 523, which is typically connected to a shutter interconnect (SH) 525 common to all shutters in the display apparatus. A shutter voltage, similar to the shutter voltage $V_s$ discussed above in relation to the shutter assembly 400 of FIGS. 2A and 2B, can be provided to the shutter terminal 523 of the light modulator 502.

The first actuation sub-circuit 512 includes a first stabilization capacitor ($C_{s1}$) 532 coupled to the first actuator 516 via the first output node 520. The voltage across the first stabilization capacitor 532 is controlled in accordance to the voltage desired at the first actuator 516 (which is based on the data provided by the data interconnect 505). The voltage on the first stabilization capacitor 532 is controlled by charging and discharging elements in the first actuation sub-circuit 512. More particularly, the first stabilization capacitor 532 is charged via the charging elements, and then selectively discharged via the discharging elements. To that end, the first actuation sub-circuit 512 includes a first charge transistor ($M_{c1}$) 530 as the charging element and includes a first discharge transistor ($M_{d1}$) 526 and a second discharge transistor ($M_{d2}$) 528 as discharging elements. A first actuation interconnect ($AC_1$) 534, coupled to the first actuation sub-circuit 512, serves as a source and a sink for charging and discharging the first stabilization capacitor 532.

The first actuation interconnect 534 is coupled to the first stabilization capacitor 532 via the first charge transistor 530 having a diode connected configuration. More particularly, the first actuation interconnect 534 is coupled to both the gate and the drain terminals of the first charge transistor 530. The other terminal of the first stabilization capacitor 532 is coupled to the common interconnect 509. As will be discussed below, the first stabilization capacitor 532 is charged by a voltage being applied to the first actuation interconnect 534 via the diode connected first charge transistor 530.

A discharge path from the first stabilization capacitor 532 to the first actuation interconnect 534 includes the first discharge transistor ($M_{d1}$) 526 and the second discharge transistor ($M_{d2}$) 528. Specifically, the first stabilization capacitor 532 is coupled to the drain terminal of the second discharge transistor 528 at the first output node 520. The source terminal of the second discharge transistor 528 is coupled to the drain terminal of the first discharge transistor 526. Finally the discharge path is completed by the source terminal of the first discharge transistor being coupled to the first actuation interconnect 534.

The second actuation sub-circuit 514 includes a second stabilization capacitor (Cs2) 540 coupled to the second actuator 522 at the second output node 524. The second actuation sub-circuit 514 controls the voltage provided to the second actuator 522 by controlling the voltage of the second stabilization capacitor 540. Similar to the first actuation sub-circuit 512, the second actuation sub-circuit 514 also includes charging elements and discharging elements for charging and discharging the second stabilization capacitor 540. In particular, the second actuation sub-circuit 514 includes a second charge transistor (Mc2) 536 as the charging element and a third discharge transistor (Md3) 538 as a discharging element. A second actuation interconnect (AC2) 542 serves as a source and a sink for charging and discharging the second stabilization capacitor 540.

As shown in FIG. 3, the second actuation interconnect 542 is coupled to the second stabilization capacitor 540 via the second charge transistor 536 having a diode connected configuration. More particularly, the second actuation interconnect 542 is coupled to both the gate and drain terminals of the second charge transistor 536. The source terminal of the second charge transistor 536 is coupled to the second stabilization capacitor 540 at the second output node 524. As will be discussed below, the second stabilization capacitor 540 is charged by the voltage on the second actuation interconnect 542 via the diode connected second charge transistor 536.

A discharge path from the second stabilization capacitor 540 to the second actuation interconnect 542 includes the third discharge transistor 538. Specifically, the second stabilization capacitor 540 is coupled to the drain terminal of the third discharge transistor 538 at the second output node 524, while the source of the third discharge transistor is coupled to the second actuation interconnect 542.

As mentioned above, the first actuation sub-circuit 512 and the second actuation sub-circuit 514 are cross-coupled. Specifically, the gate terminal of the second discharge transistor 528 is coupled to the second output node 524, while the gate terminal of the third discharge transistor 538 is coupled to the node where the drain of the first discharge transistor 526 is coupled to the source of the second discharge transistor 528. This cross coupling allows the actuation circuit 506 to act as a latch for storing output voltages associated with the first actuator 516 and the second actuator 522 in the first stabilization capacitor 532 and the second stabilization capacitor 540, respectively.

In some implementations, the first actuation sub-circuit 512 and the second actuation sub-circuit 514 are also coupled via an equalization transistor ($M_{eq}$) 544. Specifically, the equalization transistor 544 is connected between the first output node 520 of the first actuation sub-circuit 512 and the second output node 524 of the second actuation sub-circuit 514. The gate terminal of the equalization transistor 544 is coupled to the first actuation interconnect 534. By controlling the equalization transistor 544, the voltages at the first output node 520 and the second output node 524 can be equalized.

Specifically, by switching the equalization transistor 544 ON, current flow can be permitted between the first stabilization capacitor 532 and the second stabilization capacitor 540. Thus, if the voltage across one of the stabilization capacitors becomes greater than that across the other during previous addressing cycles, the switching ON of the equalization transistor 544 would result in current to flow between the stabilization capacitors 532 and 540. The flow of current can continue until both the stabilization capacitors 532 and 540 are at substantially the same potential. As the voltages at the first output node 520 and the second output node 524 is the same as the voltages across the first stabilization capacitor 532 and the second stabilization capacitor 540, respectively, the voltages at the first output node 520 is also equalized with the voltage at the second output node 524.

Figure 4:
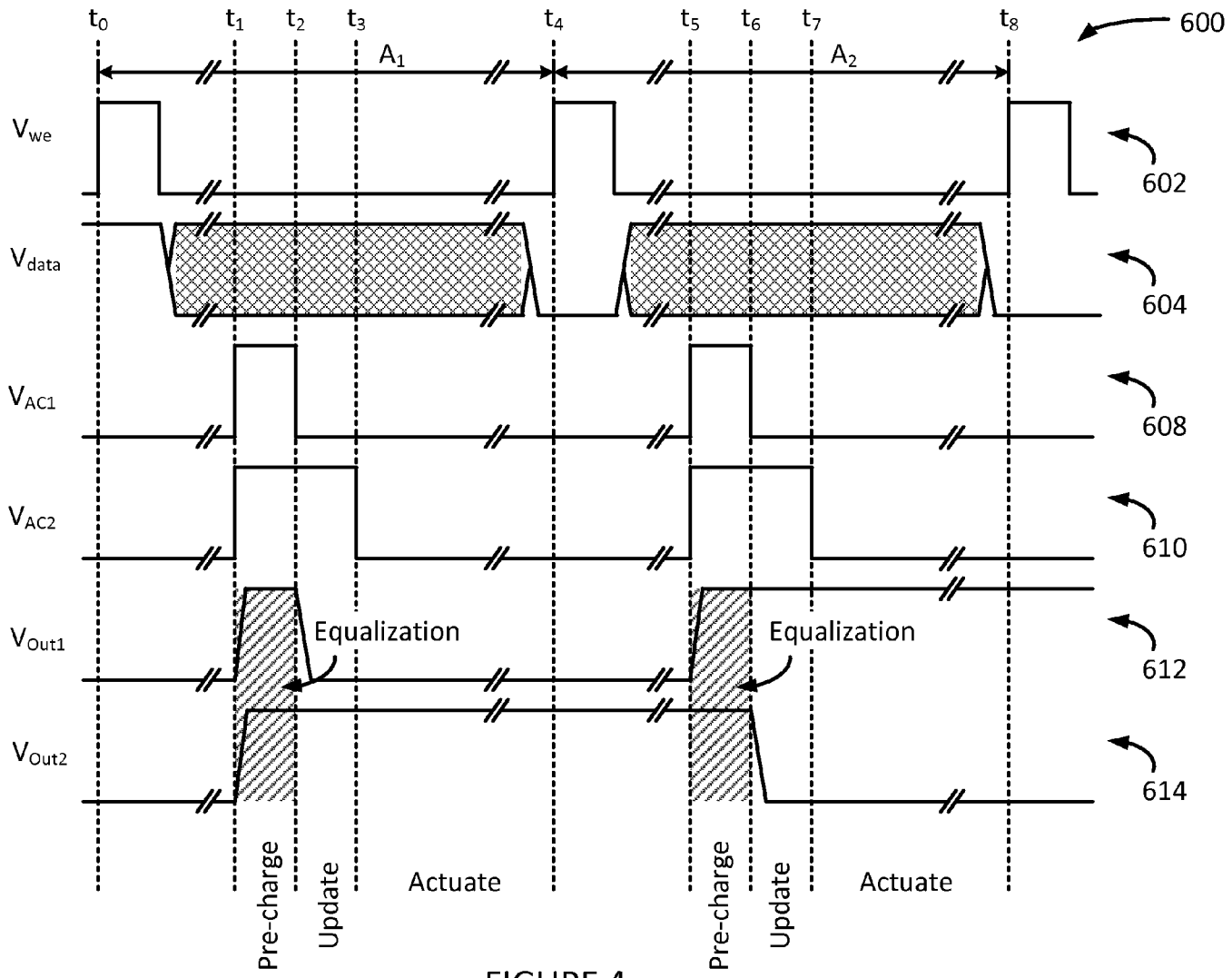
FIG. 4 shows an example timing diagram for the pixel circuit shown in FIG. 3.

FIG. 4 shows an example timing diagram 600 for the pixel circuit 500 shown in FIG. 3. In particular, the timing diagram 600 shows voltage levels at various nodes of the pixel circuit 500 of FIG. 3 over two addressing cycles $A_1$ and $A_2$. A voltage ($V_{we}$) 602 represents the write enabling voltage on the write enabling interconnect 507, a voltage ($V_{data}$) 604 represents the data voltage on the data interconnect 505, a voltage ($V_{AC1}$) 608 represents the first actuation voltage on the first actuation interconnect 534, a voltage ($V_{AC2}$) 610 represents the second actuation voltage on the second actuation interconnect 542, a voltage ($V_{Out1}$) 612 represents the first output voltage on the first output node 520, and a voltage ($V_{Out2}$) 614 represents the second output voltage on the second output node 524. Each voltage shown in FIG. 4 generally swings between a high and a low value. But the high and low values for any one voltage may or may not be equal to the high and low values for another voltage. The rise and fall times for various voltages in the timing diagram 600 are merely for illustration, and may not represent the actual rise and fall times of these voltages.

The first addressing cycle $A_1$ begins at time $t_0$ with the write enabling voltage 602 on the write enabling interconnect going high. Referring to FIG. 3, the write enabling interconnect 507 is coupled to the gate terminal of the write enabling transistor 508 of the data loading circuit 504. Thus, when the write enabling voltage 602 goes high, the write enabling transistor 508 is switched ON. Thus, the write enabling transistor 508 will allow current to flow between the data interconnect 505 and the data storage capacitor 510. As shown in FIG. 4, at time t0, the data voltage 604 on the data interconnect 505 is high. Therefore, the data storage capacitor 510 will be charged to a high voltage as well. After some time, the write enabling voltage 602 goes low, which results in the write enabling transistor 508 to switch OFF. Thus, the voltage representing the data on the data interconnect 505 is stored in the data storage capacitor 510. The write enabling voltage 602 going low indicates that the data for the row including the pixel associated with the pixel circuit 500 has been loaded. After this time, data interconnect 505 may be used for loading data to pixels on other rows of the display apparatus. Thus, after the data for the pixel associated with the pixel circuit 500 has been loaded, the pixel circuit 500 may disregard the data voltage 604 on the data interconnect 505 for a duration indicated by cross-hatched pattern in the data voltage 604.

At time $t_1$, the pixel circuit 500 of FIG. 3 enters a pre-charge phase. In the pre-charge phase, the first actuation voltage 608 and the second actuation voltage 610 become high. Referring again to FIG. 3, a high first actuation voltage 608 on the first actuation interconnect 534 causes the diode connected first charge transistor 530 to switch ON. This causes the first stabilization capacitor 532 to be pre-charged to a high voltage. Similarly, a high second actuation voltage 610 causes the second stabilization capacitor 540 to also pre-charge to a high voltage via the diode connected second charge transistor 536. Thus, the first output node 520 and the second output node 524 are each placed at voltages corresponding to the first stabilization capacitor 532 and the second stabilization capacitor 540, respectively.

Still referring to FIGS. 3 and 4, the high voltage on the first actuation interconnect 534 also switches ON the voltage equalization transistor 544. As shown in FIG. 3, the voltage equalization transistor 544 is coupled between the first output node 520 and the second output node 524. Therefore, when the voltage equalization transistor 544 switches ON, it allows current to flow between the first stabilization capacitor 532 coupled to the first output node 520 and the second stabilization capacitor 540 coupled to the second output node 524. The current flow between the first and second stabilization capacitors 532 and 540 equalizes the voltages on these two capacitors.

It should be noted that in the absence of voltage equalization, the voltage at the second output node 524 may be undesirably boosted due to capacitor bootstrapping. Specifically, the capacitance between the gate terminal and the drain terminal (i.e., the terminal coupled to the first output node 520) of the second discharge transistor 528, is coupled between the first output node 520 and the second output node 524. The voltage on the first output node 520 increases when the first stabilization capacitor 532 is charged during the pre-charge phase. But this increase in the voltage of the first output node 520 also increases the voltage on one terminal of the capacitor formed by the gate terminal and the source terminal of the second discharge transistor 528. As a result, due to capacitor bootstrapping, the voltage at the second output node 524 also increases. The undesirable increase in the voltage at the second output node 524 may last for a fraction of the duration of the pre-charge phase. Nonetheless, the increase in voltage at the second output node 524 may affect the reliability of the second actuator 522 of the light modulator 502.

Thus, by providing voltage equalization between the first output node 520 and the second output node 524 via the equalization transistor 544, the voltages at the first actuator 512 and the second actuator 522 are maintained substantially equal, thereby reducing the risk of undesirable operation of the second actuator 522.

At time $t_2$, the pixel circuit 500 of FIG. 3 enters an update phase. In the update phase, the first actuation voltage 608 is pulled low while the second actuation voltage 610 is maintained at a high value. The first actuation voltage 608 going low causes the first charge transistor 530 and the voltage equalization transistor 544 to switch OFF; thus, preventing any further voltage equalization between the first output node 520 and the second output node 524. The first actuation voltage 608 going low also causes the first discharge transistor 526 to be controlled by the data voltage stored in the data storage capacitor 510.

As discussed above, the data storage capacitor 510 is charged to a high voltage because the data voltage 604 provided by the data interconnect 505 was high when the write enabling transistor 508 was switched ON. Thus, the gate terminal of the first discharge transistor 526 is high while its source terminal is low. Therefore, the first discharge transistor 526 switches ON, pulling the source terminal of the second discharge transistor 528 low. As the gate terminal of the second discharge transistor 528 is coupled to the second output node 524, which is high, the second discharge transistor 528 also switches ON. As both the first discharge transistor 526 and the second discharge transistor 528 are switched ON, and the first actuation interconnect 534 is at a low voltage, the charge stored in the first stabilization capacitor 532 is discharged via the first discharge transistor 526 and the second discharge transistor 528. Thus, as shown in FIG. 4, the first actuation voltage 612 goes low.

Again referring to FIGS. 3 and 4, while the first stabilization capacitor 530 is discharged, the second stabilization capacitor 540 is maintained in a charged state. This is because the second actuation interconnect 542 is still high, which maintains the charge on the second stabilization capacitor 540. Furthermore, the gate terminal of the third discharge transistor 538 is low, because it is coupled to the drain terminal of the first discharge transistor 526. Therefore, the third discharge transistor 538 is switched OFF. As a result, the third discharge transistor 538 does not provide a path for the charge stored in the second stabilization capacitor 540 to dissipate.

As shown in FIG. 4, the pixel circuit 500 of FIG. 3 transitions from the update phase to the actuate phase at time $t_3$, at which time the second actuation voltage 610 goes low. This results in the diode connected second charge transistor 536 to switch OFF. Thus, the second stabilization capacitor 540 is isolated from the second actuation interconnect 542. Additionally, the third discharge transistor 538 is still switched OFF. Therefore, there is no current path for the charge stored in the second stabilization capacitor 540 to dissipate. Therefore, the second stabilization capacitor 540 maintains the high voltage to which it was charged in the preceding pre-charge and update phases. As a result, the second output node 524 is maintained at a high second output voltage 614.

As mentioned above, the light modulator 502 of FIG. 3 is coupled to the actuation circuit 506. Specifically, the first actuator 516 is coupled to the first output node 520 while the second actuator 522 is coupled to the second output node 524. During the actuate phase, the first output voltage 612 at the first output node 520 is low, while the second output voltage 614 at the second output node 524 is high. In some implementation, this causes the first actuator 516 to be de-actuated and the second actuator 522 to be actuated. When the second actuator 522 of the light modulator 502 is actuated, the light modulator 502 is in an open state. That is, the light modulator 502 allows light from the backlight to pass towards the front of the display apparatus. It should be understood that in some other implementations the voltages on the first and second output nodes 520 and 524 may cause the opposite behavior in the light modulator 502. For example, a low first output voltage 612 may cause the first actuator 516 to be actuated, while a high second output voltage 614 may cause the second actuator 522 to be de-actuated. As a result, the light modulator 502 may be switched to a closed state, thereby blocking light from the backlight to pass towards the front of the display apparatus. To reduce charge buildup, a controller may regularly change the configuration of the first actuator 516 and the second actuator 522 to respond such that they may be actuated with different voltages in different time periods.

Referring to FIG. 4, the actuate phase continues until time $t_4$, at which time the second addressing cycle $A_2$ begins. However, before the beginning of the second addressing cycle $A_2$, the data voltage on the data interconnect 505 goes low. This can be due to the change in data (from '1' to '0') corresponding to the pixel associated with the pixel circuit 500. At time $t_4$, the write enabling voltage 602 on the write enabling interconnect 507 goes high. As described above with respect to the first addressing cycle $A_1$, the write enabling voltage 602 allows the data provided on the data interconnect 505 to be stored in the data storage capacitor 510. Thus, after the write enabling voltage 602 goes low, the data storage capacitor 510 is discharged to a low value representing the data value of '0' on the data interconnect 505.

At time $t_5$, the pixel circuit 500 of FIG. 3 enters the pre-charge phase. As in the first addressing cycle $A_1$, the pre-charge phase of the second addressing cycle $A_2$ also pre-charges the first stabilization capacitor 532 and the second stabilization capacitor 540 to a high voltage. This is accomplished by the first actuation voltage 608 and the second actuation voltage 610 going high. Furthermore, as the first actuation voltage 608 is high, the equalization transistor 544 is switched ON. This equalizes the voltages of the first stabilization capacitor 532 and the second stabilization capacitor 540. As the second actuation voltage 610 on the second stabilization capacitor 540 is also high, the second discharge transistor 528 is switched ON, which results the voltage on the gate terminal of the third discharge transistor 538 to be high. But, because the second actuation voltage 610 is high, the third discharge transistor 538 does not switch ON, and, therefore, does not discharge the second stabilization capacitor 540. At the end of the pre-charge phase, both the first output voltage 612 and the second output voltage 614 on the first output node 520 and the second output node 524, respectively, are high.

At time $t_6$, the pixel circuit 500 of FIG. 3 enters the update phase. In the update phase, the first actuation voltage 608 on the first actuation interconnect 534 goes low. This allows the first discharge transistor 526 to respond to the data value stored in the data storage capacitor 510. But the data voltage of the data storage capacitor 510 is low. Therefore, the first discharge transistor 526 remains switched OFF. Furthermore, because the first actuation voltage 608 is low, the first charge transistor 530 is switched OFF. In addition, the equalization transistor 544 is also switched OFF, isolating the first output node 520 from the second output node 524. Thus, the charge on the first stabilization capacitor 532 is maintained resulting in the first output voltage 612 to remain high.

At time $t_7$, the update phase ends with the second actuation voltage 610 on the second actuation interconnect 542 going low. As a result, the gate terminal voltage of second charge transistor 536 goes low. This causes the second charge transistor 536 to switch OFF. Furthermore, the source terminal of the third discharge transistor 538, which receives the second actuation voltage 610, also goes low. As the gate of the third discharge transistor 538 is high, the third discharge transistor 538 is switched ON. Thus, the second stabilization capacitor 540 is discharged. As a result, the second output voltage 614 on the second output node 524 is pulled low.

Thus, during the actuate phase of the second addressing cycle $A_2$, the first actuation voltage supplied to the first actuator 516 of the light modulator 502 is high, while the second actuation voltage 610 provided to the second actuator 522 is low. Thus, the first actuator 516 is actuated while the second actuator 522 is not actuated. When the first actuator 516 of the light modulator 502 is actuated, the light modulator 502 is in a closed state. That is, the light modulator 502 does not allow light from the backlight to pass towards the front of the display apparatus.

Figure 5:
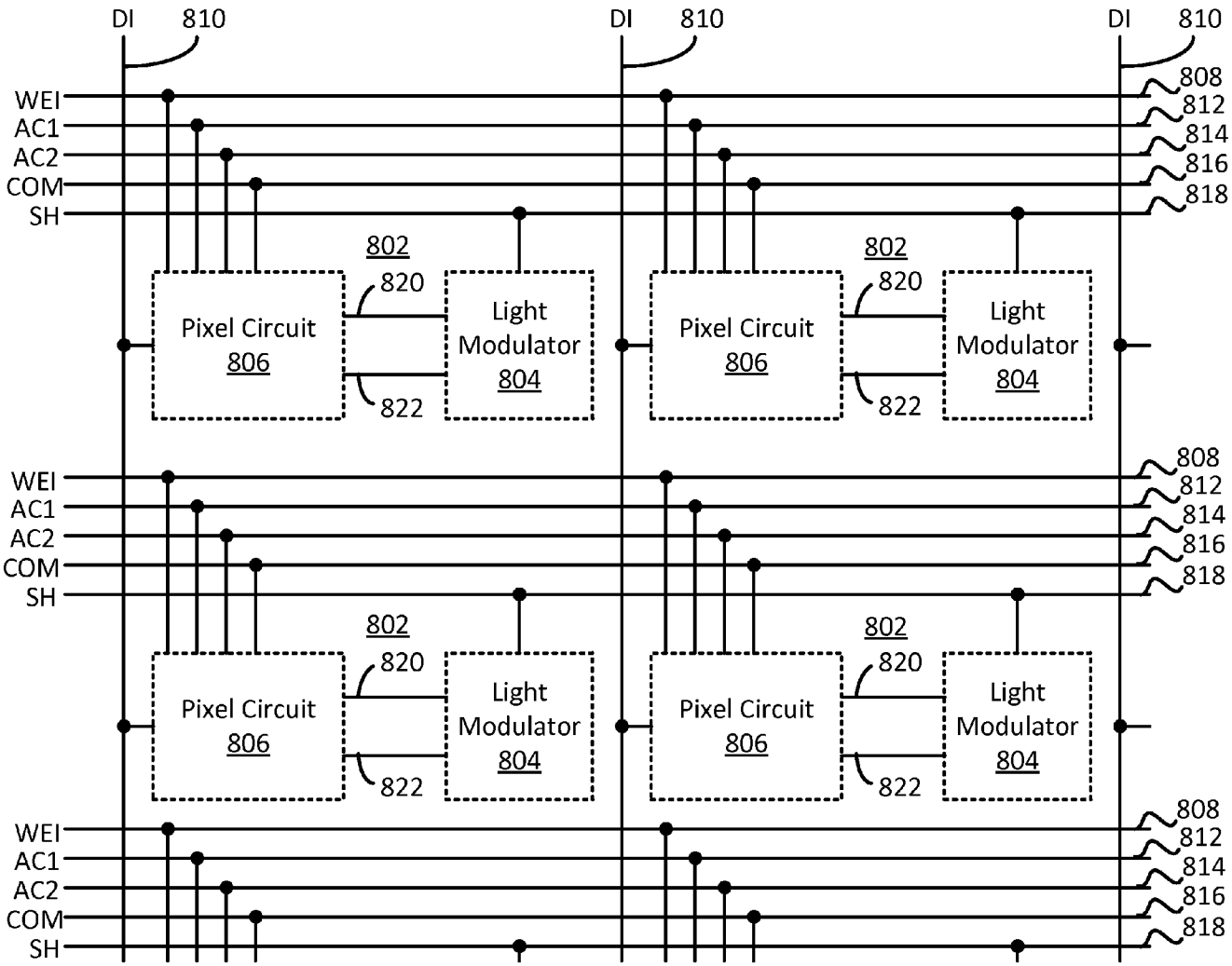
FIG. 5 shows a schematic diagram of an example control matrix 800.

FIG. 5 shows a schematic diagram of an example control matrix 800. The control matrix 800 is suitable for controlling the light modulators incorporated into the MEMS-based display apparatus 100 of FIG. 1A. The control matrix 800 may address an array of pixels 802. Each pixel 802 can include a light modulator 804, such as the dual actuator shutter assembly 400 of FIGS. 2A and 2B. Each pixel 802 can also include a pixel circuit 806, such as the pixel circuit 500 of FIG. 3. While FIG. 5 shows the control matrix having only two rows and two columns of pixel 802, it is understood that the control matrix 800 can include additional multiple rows and multiple columns of pixels 802.

The control matrix 800 includes a write enable interconnect (WEI) 808 for each row of pixels 802 in the control matrix 800 and a data interconnect (DI) 810 for each column of pixels 802 in the control matrix 800. The write enable interconnect 507 and the data interconnect 505 shown in FIG. 3 are examples of such interconnects. Each write enable interconnect 808 electrically connects a write-enabling voltage source to the pixels 802 in a corresponding row of pixels 802. Each data interconnect 810 electrically connects a data voltage source to the pixels 802 in a corresponding column of pixels 802.

The control matrix 800 also includes interconnects that are common to pixels 802 in multiple rows and multiple columns of the control matrix 800. In some implementations, the interconnects are common to pixels 802 in all rows and columns of the control matrix 800. The control matrix 800 includes a first actuation interconnect (AC1) 812, a second actuation interconnect (AC2) 814, a common interconnect (COM) 816 and a shutter interconnect (SH) 818. The first actuation interconnect 534, the second actuation interconnect 542, the common interconnect 509 and the shutter interconnect 525 shown in FIG. 3 are examples of such interconnects. As such, the first actuation interconnect 812 and the second actuation interconnect 814 can provide a first actuation voltage and a second actuation voltage for the operation of the pixel circuit 806, the common interconnect 816 can provide a common ground or reference voltage for the operation of the pixel circuits 806, and the shutter interconnect 818 can provide a shutter voltage to each shutter in each light modulator 804.

In operation, to form an image, the control matrix 800 write-enables each row in the matrix 800 in a sequence by applying a write enabling voltage to each write enable interconnect 808 in turn. While the row is write-enabled, data voltages are selectively applied to the data interconnects 810. For a write-enabled row, the application of the write enabling voltage enables the data loading circuit of each pixel circuit 806 to store the data voltage provided on the data interconnect 810. After providing data to all the pixels 802 in all the rows, the control matrix 800 controls the voltages on the first actuation interconnect 812 and the second actuation interconnect 814 in a manner that is similar to that shown for first actuation interconnect 534 and the second actuation interconnect 542 in relation to FIGS. 3 and 4 above.

Figure 6:
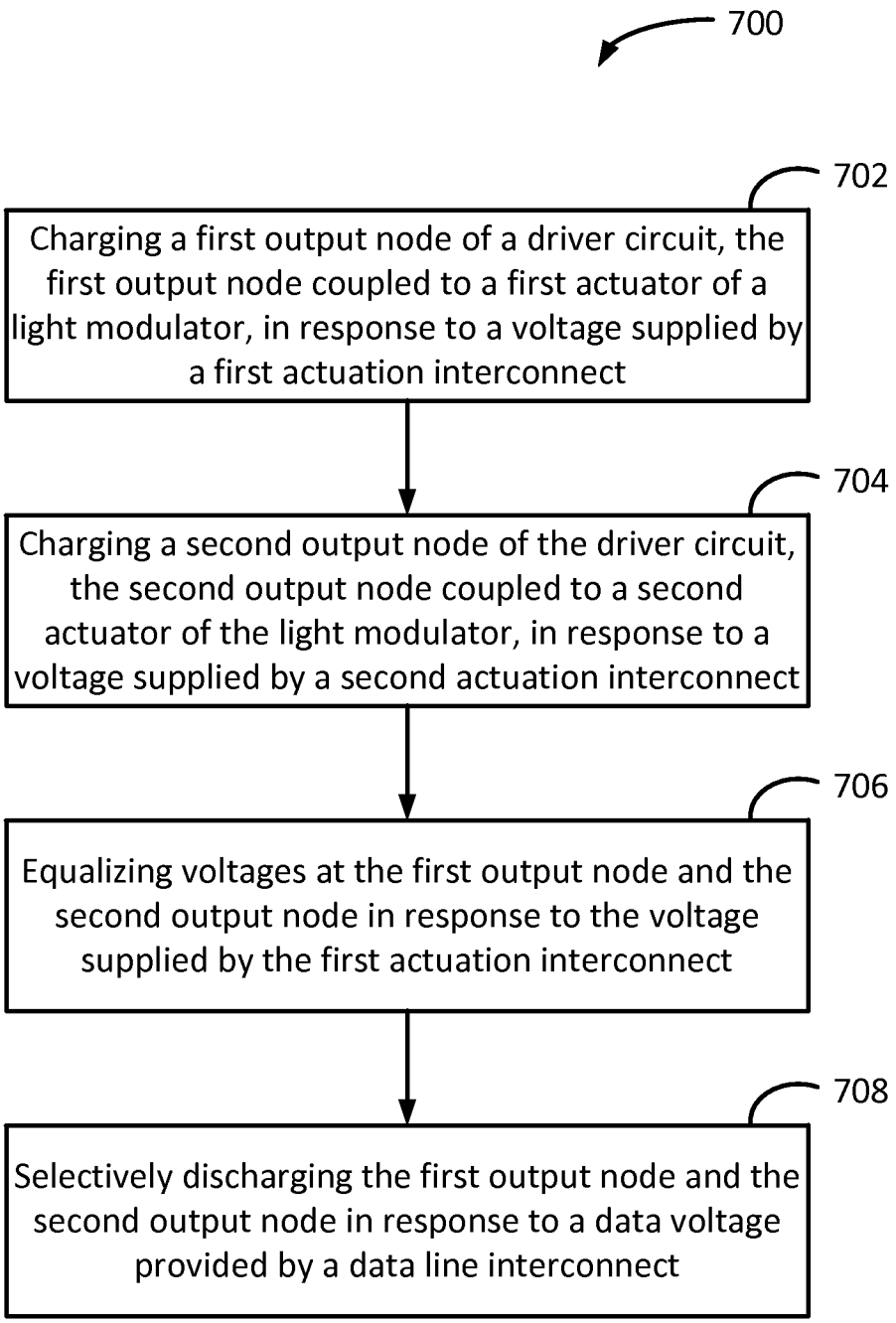
FIG. 6 shows an example flow diagram of a process for operating a dual actuator light modulator using a pixel circuit.

FIG. 6 shows an example flow diagram of a process 700 for operating a dual actuator light modulator using a pixel circuit. In particular the process 700 includes charging a first output node of the pixel circuit, the first output node coupled to a first actuator of the light modulator, in response to a voltage supplied by a first actuation interconnect (stage 702), charging a second output node of the pixel circuit, the second output node coupled to a second actuator of the light modulator, in response to a voltage supplied by a second actuation interconnect (stage 704), equalizing voltages at the first output node and the second output node in response to the voltage supplied by the first actuation interconnect (stage 706), and selectively discharging the first output node and the second output node in response to a data voltage provided by a data interconnect (stage 708).

The process 700 begins with charging a first output node of the pixel circuit, the first output node coupled to a first actuator of the light modulator, in response to a voltage supplied by a first actuation interconnect (stage 702). One example of this process stage has been discussed above in relation to FIGS. 3 and 4. Specifically, FIG. 3 shows a light modulator 502 controlled by a pixel circuit 500. A first output node 520 of the pixel circuit 500 is coupled to the first actuator 516 of the light modulator 502. The first output node 520, as shown in FIG. 4, is pre-charged at time $t_1$ in response to a first actuation voltage 608 provided by the first actuation interconnect 534. In particular, when the first actuation voltage 608 goes high, the first stabilization capacitor 532, which is coupled to the first output node 520, is charged via the diode connected first charge transistor 530.

The process 700 also includes charging the second output node of the pixel circuit, the second output node coupled to the second actuator of the light modulator, in response to the voltage supplied by a second actuation interconnect (stage 704). One example of this process stage has been discussed above in relation to FIGS. 3 and 4. Specifically, FIG. 3 shows a second output node 524 of the pixel circuit 500 is coupled to the second actuator 522 of the light modulator 502. The second output node 524, as shown in FIG. 4, is pre-charged at time $t_1$ in response to a second actuation voltage 610 provided by the second actuation interconnect 542. In particular, when the second actuation voltage 610 goes high, the second stabilization capacitor 540, which is coupled to the second output node 524, is charged via the diode connected second charge transistor 536.

The process 700 also includes equalizing voltages at the first output node and the second output node in response to the voltage supplied by the first actuation interconnect (stage 706). One example of this process stage has been discussed above in relation to FIGS. 3 and 4. In particular, FIG. 4 shows that at time $t_1$, when the first actuation voltage 608 goes high, the first output voltage 612 at the first output node 520 is equal to the second output voltage 614 at the second output node 524. The equalization of the voltages is carried out by switching ON an equalization transistor 544, shown in FIG. 3, by the first actuation voltage 608 ON the first actuation interconnect 534.

The process 700 also includes selectively discharging the first output node and the second output node in response to a data voltage provided by a data interconnect (stage 708). One example of this process stage has been discussed above in relation to FIGS. 3 and 4. In particular, FIG. 4 shows at time $t_2$ and again at time $t_6$ one of the first output node voltage 612 and the second output node voltage 614 is pulled low indicating a discharged corresponding node. As shown in FIG. 3, the discharging of the first output node 520 or the second output node 524 is based on the data voltage input at the base terminal of the first discharge transistor 526. If the data voltage is high, then the first output node 520 is discharged, but if the data voltage is low, then the second output node 524 is discharged.

Figure 7A:
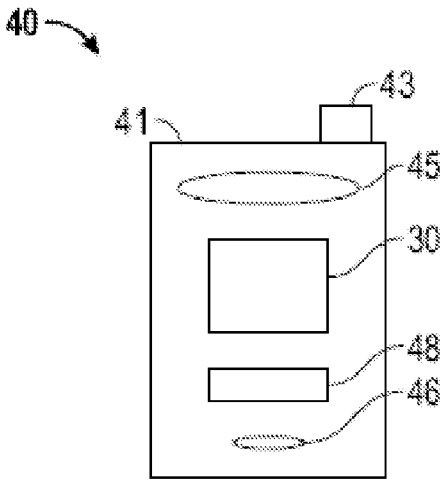
FIGS. 7A and 7B show system block diagrams of an example display device that includes a plurality of display elements.
Figure 7B:
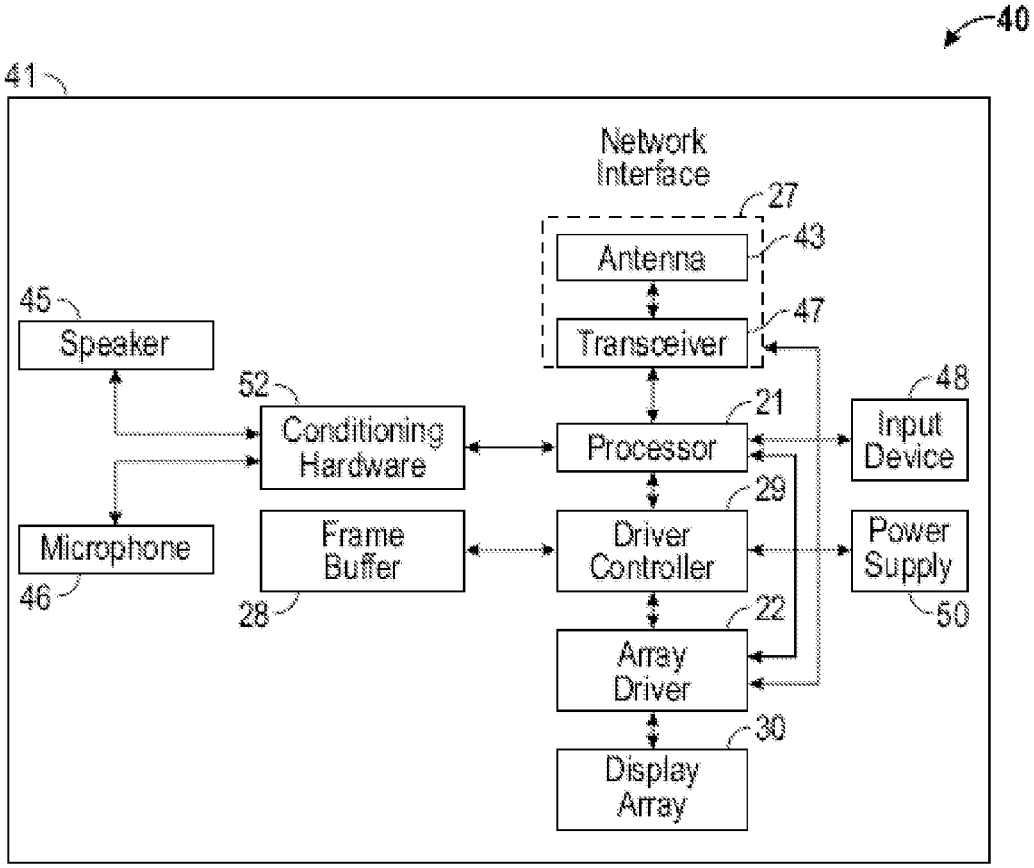

FIGS. 7A and 7B show system block of an example display device 40 that includes a plurality of display elements. The display device 40 can be, for example, a smart phone, a cellular or mobile telephone. However, the same components of the display device 40 or slight variations thereof are also illustrative of various types of display devices such as televisions, computers, tablets, e-readers, hand-held devices and portable media devices.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be configured to include a flat-panel display, such as plasma, electroluminescent (EL) displays, OLED, super twisted nematic (STN) display, LCD, or thin-film transistor (TFT) LCD, or a non-flat-panel display, such as a cathode ray tube (CRT) or other tube device. In addition, the display 30 can include a mechanical light modulator-based display, as described herein.

The components of the display device 40 are schematically illustrated in FIG. 7B. The display device 40 includes a housing 41 and can include additional components at least partially enclosed therein. For example, the display device 40 includes a network interface 27 that includes an antenna 43 which can be coupled to a transceiver 47. The network interface 27 may be a source for image data that could be displayed on the display device 40. Accordingly, the network interface 27 is one example of an image source module, but the processor 21 and the input device 48 also may serve as an image source module. The transceiver 47 is connected to a processor 21, which is connected to conditioning hardware 52. The conditioning hardware 52 may be configured to condition a signal (such as filter or otherwise manipulate a signal). The conditioning hardware 52 can be connected to a speaker 45 and a microphone 46. The processor 21 also can be connected to an input device 48 and a driver controller 29. The driver controller 29 can be coupled to a frame buffer 28, and to an array driver 22, which in turn can be coupled to a display array 30. One or more elements in the display device 40, including elements not specifically depicted in FIG. 7A, can be configured to function as a memory device and be configured to communicate with the processor 21. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to the IEEE 16.11 standard, including IEEE 16.11(a), (b), or (g), or the IEEE 802.11 standard, including IEEE 802.11a, b, g, n, and further implementations thereof. In some other implementations, the antenna 43 transmits and receives RF signals according to the Bluetooth® standard. In the case of a cellular telephone, the antenna 43 can be designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1xEV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G, 4G or 5G technology. The transceiver 47 can preprocess the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that can be readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a standalone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements. In some implementations, the array driver 22 and the display array 30 are a part of a display module. In some implementations, the driver controller 29, the array driver 22, and the display array 30 are a part of the display module.

In some implementations, the driver controller 29, the array driver 22, and the display array 30 are appropriate for any of the types of displays described herein. For example, the driver controller 29 can be a conventional display controller or a bi-stable display controller (such as a mechanical light modulator display element controller). Additionally, the array driver 22 can be a conventional driver or a bi-stable display driver (such as a mechanical light modulator display element driver). Moreover, the display array 30 can be a conventional display array or a bi-stable display array (such as a display including an array of mechanical light modulator display elements). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits and algorithm processes described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and processes described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, e.g., a combination of a DSP and a microprocessor, a plurality of microprocessors, one or more microprocessors in conjunction with a DSP core, or any other such configuration. In some implementations, particular processes and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The processes of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD- ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of any device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one or more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. An apparatus comprising:

an array of display elements; and a control matrix configured to control the optical output of the array of display elements, the control matrix including for each of the display elements:

a first circuit including:

a first charge transistor configured to govern the application to a first node of a respective display element of a first actuation voltage supplied by a first actuation voltage interconnect, and a first discharge transistor configured to selectively discharge the voltage applied to the first node in response to a data signal supplied to the gate of the first discharge transistor;

a second circuit including:

a second charge transistor configured to govern the application to a second node of the respective display element of a second actuation voltage, and a second discharge transistor configured to selectively discharge the voltage applied to the second node in response to the voltage on the first node; and a voltage equalization switch selectively coupling the first node to the second node in response to the first actuation voltage supplied by the first actuation interconnect, wherein the first node and the second node correspond to a first output and second output coupled to a first actuator and a second actuator, respectively, of the respective display element, and wherein the first actuator and the second actuator govern a state of the respective display element.

2. The apparatus of claim 1, wherein the first circuit further includes:

a third discharge transistor positioned between a first terminal of the first charge transistor and a first terminal of the first discharge transistor configured to selectively retain a voltage on the first node responsive to a voltage stored on the second node.

3. The apparatus of claim 1, wherein the first actuation voltage interconnect couples to the gate and the drain of the first charge transistor and the gate of the voltage equalization switch.

4. The apparatus of claim 3, wherein the first actuation voltage interconnect is further coupled to a second terminal of the first discharge transistor.

5. The apparatus of claim 1, further comprising a first capacitor coupled to the first node and a second capacitor coupled to the second node.

6. The apparatus of claim 1, further including a data storage circuit coupled to the gate of the first discharge transistor, the data storage circuit configured to store the data signal corresponding to a data input and supply the data signal to the gate of the first discharge transistor.

7. The apparatus of claim 6, wherein the data storage circuit includes a data storage capacitor coupled to the gate of the first discharge transistor, the data storage capacitor configured to store charge corresponding to the data signal.

8. The apparatus of claim 1, wherein all transistors of the first circuit and the second circuit are nMOS transistors.

9. The apparatus of claim 1, further comprising:

a display including:

the array of display elements, and the control matrix, a processor that is configured to communicate with the display, the processor being configured to process image data; and a memory device that is configured to communicate with the processor.

10. The apparatus of claim 9, the display further including:

a driver circuit configured to send at least one signal to the display; and a controller configured to send at least a portion of the image data to the driver circuit.

11. The apparatus of claim 9, further including:

an image source module configured to send the image data to the processor, wherein the image source module comprises at least one of a receiver, transceiver, and transmitter.

12. The apparatus of claim 9, the display device further including:

an input device configured to receive input data and to communicate the input data to the processor.

13. A method for actuating a light modulator having a first actuator and a second actuator using a pixel circuit coupled to the light modulator, the method comprising:

charging a first output node of the pixel circuit, the first output node coupled to the first actuator, by, and in response to, a voltage supplied by a first actuation interconnect;

charging a second output node of the pixel circuit, the second output node coupled to the second actuator, by, and in response to, a voltage supplied by a second actuation interconnect;

equalizing voltages at the first output node and the second output node in response to the voltage supplied by the first actuation interconnect; and selectively discharging the first output node and the second output node in response to a data voltage provided by a data interconnect, wherein the first actuator and the second actuator govern a state of the light modulator.

14. The method of claim 13, further comprising:

activating a latching circuitry for maintaining voltages at the first output node and the second output node after selectively discharging the first output node and the second output node.

15. The method of claim 13, wherein equalizing voltages at the first output node and the second output node includes allowing current to flow between the first output node and the second output node via a switch driven by the voltage provided by the first actuation interconnect.

16. The method of claim 15, wherein equalizing voltages at the first output node and the second output node further includes discontinuing current flow between the first output node and the second output node via the switch prior to selectively discharging the first output node and the second output node.

17. The method of claim 13, wherein a duration for charging the first output node is less than a duration for charging the second output node.

18. An apparatus comprising:

an array of display elements; and control matrix means for controlling the optical output of the array of display elements, the control matrix means including for each of the display elements:

a first circuit including:

first charging means for governing the application to a first node of a respective display element of a first actuation voltage supplied by a first actuation voltage interconnect, and first discharging means for selectively discharging the voltage applied to the first node in response to a data signal supplied to the gate of the first discharge transistor;

a second circuit including:

second charging means for governing the application to a second node of the respective display element of a second actuation voltage, and second discharging means for selectively discharging the voltage applied to the second node in response to the voltage on the first node; and means for equalizing voltages at the first node and the second node in response to the first actuation voltage supplied by the first actuation interconnect, wherein the first node and the second node correspond to a first output and a second output coupled to a first actuator and a second actuator, respectively, of the respective display element, and wherein the first actuator and the second actuator govern a state of the respective display element.

19. The apparatus of claim 18, wherein the first circuit further includes:

third discharging means positioned between a first terminal of the first charging means and a first terminal of the first discharging means for selectively retaining a voltage on the first node responsive to a voltage stored on the second node.

20. The apparatus of claim 18, further comprising first charge storage means coupled to the first node for storing charge at the first node, and second charge storage means coupled to the second node for storing charge at the second node.

* * * * *